US005657065A

United States Patent [19]

Lin

[11] Patent Number: 5,657,065

[45] Date of Patent: Aug. 12, 1997

[54] POROUS MEDIUM FOR INK DELIVERY SYSTEMS

[75] Inventor: John Wei-Ping Lin, Webster, N.Y.

[73] Assignee: Xerox Corporation, Stamford, Conn.

[21] Appl. No.: 176,390

[22] Filed: Jan. 3, 1994

[51] Int. Cl.[6] ..... B41J 2/175

[52] U.S. Cl. ..... 347/93; 347/87

[58] Field of Search ..... 347/93, 86, 87; 210/488, 489, 499

[56] References Cited

U.S. PATENT DOCUMENTS

| | | | |
|---|---|---|---|
| 3,428,184 | 2/1969 | Kuper | 210/489 |
| 4,183,029 | 1/1980 | Isayama et al. | 347/93 |
| 4,306,245 | 12/1981 | Kasugayama et al. | 346/140 R |
| 4,805,656 | 2/1989 | Cole et al. | 210/489 |
| 4,875,059 | 10/1989 | Masuda | 347/93 |
| 5,006,265 | 4/1991 | Kar et al. | 210/499 |
| 5,049,138 | 9/1991 | Nakano | 347/93 |
| 5,182,581 | 1/1993 | Kashimura et al. | 346/140 R |
| 5,233,369 | 8/1993 | Carlotta et al. | 347/87 |
| 5,234,739 | 8/1993 | Tanaru et al. | 428/131 |
| 5,289,212 | 2/1994 | Carlotta | 347/87 |
| 5,317,339 | 5/1994 | Braun et al. | 347/87 |
| 5,426,459 | 6/1995 | Kaplinsky | 347/93 |

FOREIGN PATENT DOCUMENTS

| | | | |
|---|---|---|---|
| 088292 | 9/1983 | European Pat. Off. | 347/87 |
| 562733 | 9/1993 | European Pat. Off. | 347/87 |
| 214961 | 9/1987 | Japan | 347/93 |
| 207663 | 9/1991 | Japan | 347/93 |
| 110157 | 4/1992 | Japan | 347/93 |
| 5-50610 | 3/1993 | Japan | 347/93 |

OTHER PUBLICATIONS

Ims et al., "Method of Operation of Ink Jet Printer," Xerox Disclosure Journal, vol. 16, No. 4, Jul./Aug. '91, p. 233.

*Primary Examiner*—N. Le
*Attorney, Agent, or Firm*—Oliff & Berridge

[57] ABSTRACT

The invention includes an ink delivery and filtration medium for delivering and filtering ink from an ink chamber to a printhead in an ink jet system. The ink delivery and filtration medium comprises a porous woven material. The woven material can be made with fibers such as Nylons, polyethylene, polypropylene, polyethersulfone, polyesters, polyvinylidene fluoride, polytetrafluoroethylene. The woven material is flexible, thermally stable and chemically resistant to ink. The pore size and porosity of the woven material can be controlled by controlling the number of stitches per inch, fiber stitching pattern and fiber thickness or diameter. In addition, the pore size can be controlled by layering the woven material in combination with woven materials of the same or different pore sizes. Accordingly, not only can the pore size of each layer be controlled, but the pore size of the entire medium can be controlled by cumulative stacking of layers of materials with same or different pore size. The ink delivery and filtration medium provides smooth ink flow to the printhead without undesired ink clogging and impedance thereby substantially minimizing or eliminating jetting problems such as missing jets, exploding jets, and ink misdirection. In addition, restricted ink flow due to inefficient filtration and blockage of the filter by particles, debris or fibers, which causes slow ink refill and air ingestion problems resulting in slow printing speed and poor ink jet print quality can also be avoided or minimized by the steady and strong flow of ink produced with the invention.

34 Claims, 10 Drawing Sheets

POROUS MEDIUM FOR INK DELIVERY SYSTEMS

FIELD OF THE INVENTION

This invention relates to ink jet ink delivery systems. More particularly, this invention relates to a medium for ink delivery and filtration.

BACKGROUND OF THE INVENTION

Ink jet printing systems generally are of two types: continuous stream and drop-on-demand. In continuous stream ink jet systems, ink is ejected in a continuous stream under pressure through at least one orifice or nozzle. The stream of ink is periodically perturbed by pressure regulation in accordance with digital data signals, causing it to break up into droplets at a fixed distance from the nozzle. At the break-up point, the droplets are charged and passed through an electrostatic field which adjusts the trajectory of each droplet in order to direct it to a gutter for recirculation or a specific location on a recording medium. In drop-on-demand systems, a droplet is expelled from a nozzle directly to a position on a recording medium in accordance with digital data signals. A droplet is not formed or expelled unless it is to be placed on the recording medium.

Drop-on-demand systems are simpler than the continuous stream systems since they do not require ink recovery, charging, or deflection. There are three types of drop-on-demand ink jet systems. One type of drop-on-demand system has as its major component an ink filled channel or passageway having a nozzle on one end and a piezoelectric transducer near the other end to produce pressure pulses. The relatively large size of the transducer prevents close spacing of the nozzles, and the physical limitations of the transducer result in low ink drop velocity. Low drop velocity seriously diminishes tolerance for drop velocity variation and directionality, thus impacting the system's ability to produce high quality copies. Drop-on-demand systems which employ piezoelectric devices to eject the ink droplets also suffer the disadvantage of a slow printing speed.

The second type of drop-on-demand system is known as acoustic ink jet system which expels ink through a nozzle or orifice by an acoustic method. Digital data signals are sent to the acoustic transducers located near the bottom of an ink reservoir and cause the formation of an acoustic wave which propagates through the ink. The acoustic wave is focused near the top of the ink level and provides the necessary energy to expel the ink out of the nozzle toward the recording medium which is located on the top of nozzle. With this type of acoustic ink jet device it is difficult to have multiple arrays of acoustic transducers and nozzles closely packed at a small distance with great precision. This ink jet system is not entirely suitable for high speed printing.

Another type of drop-on-demand printing system is thermal ink jet printing. In existing thermal ink jet printing systems (see U.S. Pat. No. 4,463,359), the printhead comprises one or more ink filled channels having one end communicating with a relatively small ink supply chamber or manifold, and having an opening at the opposite end referred to as a nozzle. A thermal energy generator, usually a resistor, is located in each of the channels, at a predetermined distance from the nozzles. The resistors are individually addressed with a current pulse to momentarily vaporize the ink in the immediate vicinity of the resistors with an instantaneously rise of pressure and form a bubble which expels an ink droplet. As the bubble grows, the ink experiences a pressure increase due to the evaporation of ink that bulges from the nozzle and is momentarily contained by the surface tension of the ink as a meniscus. As the bubble begins to collapse, the ink in the back channel and the ink still in the channel between the nozzle and bubble start to move toward the collapsing bubble, causing a volumetric contraction of the ink at the nozzle and resulting in the separation of the bulging ink as a droplet. The acceleration of the ink out of the nozzle while the bubble is growing provides the momentum and velocity of the droplet in a substantially straight line direction towards a recording medium, such as paper and transparency. The depleting ink is refilled from the back channel which is connected to the ink supply system. When the hydrodynamic motion of the ink stops, the process is ready to start all over again. Because the droplet of ink is emitted only when the resistor is actuated by digital data signals, this general type of thermal ink-jet printing is known as "drop-on-demand" printing. The thermal ink jet printing is also commonly known as "bubble-jet" printing. This type provides a simpler and lower cost device than the continuous stream, and yet has substantially the same high speed printing capability.

The printhead of U.S. Pat. No. 4,463,359 has one or more ink filled channels which replenish ink from an ink reservoir by capillary action. A meniscus is formed at each nozzle partially due to a small negative back pressure to prevent ink from weeping therefrom. The small negative pressure in the back (or back pressure) can be created by a capillary action or by placing the ink reservoir with an ink level at a position slightly lower than that in the ink channel. A resistor or heater is located in each channel upstream from the nozzles. Current pulses representative of data signals are applied to the resistors to momentarily vaporize the ink in contact therewith and form a bubble for each current pulse. Ink droplets are expelled from each nozzle by the growth and collapse of the bubbles. The current pulses to the heater are properly applied to prevent excessive ink expulsion and premature breakage of the meniscus which can cause ink to recede too far into the channels after each droplet is expelled. Various embodiments of linear arrays of thermal ink jet devices are known, such as those having linear and staggered linear arrays of printheads attached to the top and bottom of a heat sinking substrate and those having different color inks in different printheads for multiple color printing.

A common type of printhead is known as a "sideshooter." Sideshooters are so named because the ink droplets are emitted through the ink nozzle at a right angle relative to the direction of bubble formation and growth created by a heating element. U.S. Pat. No. 4,774,530 describes such a construction in greater detail. U.S. Pat. No. 4,638,337 discloses a sideshooter in which the sudden release of vaporized ink known as blowout is prevented by disposing the heater in a recess. Another type of printhead is known as a "roofshooter" which expels ink droplets from the nozzles in the same direction as that of bubble formation and growth.

In current practical embodiments of drop-on-demand thermal ink jet printers, it has been found that the printers work most effectively when the pressure of the ink in the printhead nozzle is kept within a predetermined range of gauge pressures. Specifically; at those times during operation in which an individual nozzle or an entire printhead is not actively emitting a droplet of ink, it is important that a certain negative pressure, or "back pressure" exist in each of the nozzles and, by extension, within the ink supply manifold of the printhead. A discussion of desirable ranges for back pressure in thermal ink-jet printing is given in the "Xerox Disclosure Journal," Vol. 16, No. 4, July/August 1991, p. 233. This back pressure is important for practical applications to prevent unintended leakage, or "weeping," of liquid ink out of the nozzles onto the recording medium surface. Such weeping will obviously have adverse results on print quality of a recording medium, as liquid ink leaks out of the printhead uncontrollably.

A typical end-user product in this art is a cartridge in the form of a prepackaged, usually disposable item comprising a sealed container holding a supply of ink and, operatively attached thereto, a printhead having a linear or matrix array of ink nozzles and channels. Generally the cartridge may include terminals to interface with the electronic control of the printer. Electronic parts in the cartridge itself are associated with the ink channels and nozzles in the printhead, such as the resistors and any electronic temperature sensors, as well as digital means for converting incoming signals for imagewise operation of the heaters. In one common design of printer, the cartridge is held with the printhead close to the recording medium or sheet on which an image is to be rendered, and is then moved across the recording medium or sheet periodically according to demand, in swaths, to form the image, much like a typewriter. Typically, cartridges are purchased as needed by the consumer and used either until the supply of ink is exhausted, or until the amount of ink in the cartridge becomes insufficient to deliver the ink to the printhead or until a blockage or clog occurs.

Other considerations are crucial for practical ink supply as well. The back pressure, for instance, must be maintained at a usable level for as long as possible while there is still a supply of ink in an ink cartridge. Therefore, a cartridge must be so designed and positioned as to maintain the desired back pressure within the usable range for as large a proportion of the total range of ink levels in the cartridge as possible. The back pressure can be provided by a capillary action of an ink storage medium or by adjusting the ink level of a reservoir relative to that in the printhead. Failure to maintain necessary back pressure causes the ink remaining in the cartridge to leak out through the nozzles of a printhead or otherwise be wasted.

In another design, the cartridge and printhead can be partitioned into several sections with different color inks and ink outlets which are connected to different ink inlets and channels of an ink jet printhead. Each color ink will have its own ink holding chamber or reservoir and ink outlet which is connected to its dedicated portion of the printhead comprising many ink nozzles and channels. This type of ink jet design allows printing of either a selected ink (e.g. black, cyan, magenta, yellow, etc.) or several color inks in a single swath mode. Color images can be produced on a recording medium or sheet as the printhead moves across it.

A fast ink jet printing method uses fullwidth arrays of abutted printheads including either linear or matrix arrays of nozzles. A fullwidth printing process employs a full-width array of printheads equipped with an array of heaters or resistors and ink nozzles. A fullwidth printing process includes the recording medium or sheet being moved at high speed past a linear array of nozzles which extend across the fullwidth of the printing zone of a recording medium. As soon as the linewise printing is carried out the recording medium is advanced to allow printing of the next line. Ink is usually supplied to the fullwidth array printhead from an ink reservoir.

U.S. Pat. No. 4,095,237 discloses an ink supply to a movable printhead in which a flow path is located in the flow path of a liquid reservoir of ink in communication with the printhead. The disclosed material for the filter is foam rubber or foam plastic. The printhead is raised higher than the outlet port of the reservoir.

U.S. Pat. No. 4,419,678 discloses a modular ink supply system for an ink printer wherein a liquid ink supply container is inserted into the printing apparatus, and communicating tubes puncture the container to form a tight seal against the outlet port and ventilation port of the container.

In earlier patents, felt substances have been used for the control of the flow of liquid ink. For example, U.S. Pat. No. 4,751,527 describes an ink jet "type printer" in which a plurality of holes are formed in a film and then filled with ink. Selectively heating areas of the film generate bubbles in the ink and eject the ink due to the pressure of the bubbles, thus printing an image on a sheet. In order to convey the ink to the film at the beginning of the process, felt ink supply members are employed to act as wicks for the gradual flow of ink into the film.

U.S. Pat. No. 4,394,669 discloses an ink jet recording apparatus having a printhead which moves relative to the copy surface. Felt members are employed to act as absorbing means to collect excess effluent liquid from the printhead.

U.S. Pat. No. 4,803,502 discloses an image formation cartridge having a number of rollers for applying ink to an image formation sheet. Each ink applying roller is in contact with an ink feeding element, which is made of a material such as polytetrafluoroethylene felt.

U.S. Pat. No. 4,771,295 discloses an ink-supply cartridge construction having multiple ink storage compartments. Ink is stored in a medium of reticulated polyurethane foam of controlled porosity and capillarity. The medium empties ink into ink pipes, which are provided with wire stainless filters for filtering of air bubbles and solid particles from the ink. The foam is also compressed to reduce the pore size therein, thereby reducing the foam thickness while increasing its density; in this way, the capillary force of the foam may be increased but at an expense of slower ink flow rate. The pore sizes of polyurethane are usually not uniform and they are difficult to control in the manufacturing process. Furthermore, additives, lubricants, and unreacted materials such as diisocyanates can interact with ink causing undesired dye absorption, pigment agglomeration; and ink contamination which can lead to poor copy image quality.

U.S. Pat. No. 4,791,438 discloses an ink jet pen (ink supply) including a primary ink reservoir and a secondary ink reservoir, with a capillary member forming an ink flow path between them. This capillary member draws ink from the primary reservoir toward the secondary ink reservoir by capillary action as temperature and pressure within the primary reservoir increases. Conversely, when temperature and pressure in the housing decreases, the ink is drawn back toward the primary reservoir.

U.S. Pat. No. 4,929,969 discloses an ink supply reservoir for drop-on-demand ink jet printing, including a medium in the form of a mass of foam material. This foam material comprises a three dimensionally branched network of fine filaments creating interstitial pores of uniform size. In preferred embodiments of the invention described, this foam material is a thermoset melamine condensate. In this patent, it is further pointed out that foam materials, when used as a medium for liquid ink, exert a controlled capillary back pressure. The melamine foam is somewhat brittle and can be easily broken during a fabrication process. The debris can get into ink channels in the printhead causing missing jets, exploding jets, ink misdirectionarity, and other problems resulting in poor image quality. Furthermore, the melamine formaldehyde foam in the ink cartridge is not chemically resistant. It can be partially attacked or dissolved by water and other ink ingredients at a temperature of about 50° C., which can be reached during storage and shipment in hot weather. The dissolved foam material can deposit in ink channels of a printhead causing the blockage of ink paths and other printing problems.

Pending U.S. patent application Ser. No. 07/885,704, having the same assignee and which is incorporated herein by reference, discloses a system for supplying liquid ink to a thermal ink jet printing apparatus with a housing defining a single chamber having a ventilation port and an outlet port. An ink medium occupies at least a portion of the chamber, and is adapted to retain a quantity of liquid ink. A scavenger member, preferably made of acoustic melamine foam, is disposed across the outlet port providing a capillary force greater than that of the medium. A single layer filter can be attached to the scavenger.

The existing ink delivery systems fail to provide and maintain a high quality print with good optical density, in large part, due to the break-up and deterioration of the existing foam and felt ink mediums. The dislodged fibers particles and debris are identified as a large cause of ink channel blocking. Ink channel blockage can result in ink dropout, missing jets, exploding jets and other jetting problems. Although wire mesh or single layer filters have been used between the ink medium and the nozzle to filter particles, these filters suffer from inefficient filtration and blockage because they filter particles, debris or fibers on a single plane. This filtration causes slow ink refill and air ingestion problems at the printhead resulting in slow print speed and poor ink jet print quality. What is needed is an ink delivery and filtration medium that is capable of filtering out various size particles, fibers or debris while maintaining a strong and steady ink flow to the nozzle so that a high quality printing with good optical density can be achieved and maintained.

SUMMARY OF THE INVENTION

Accordingly, it is a primary object of the invention to provide a ink delivery and filtration medium.

Another object of the invention is to provide an ink delivery and filtration medium that has a controllable pore size and porosity and controllable ink paths.

Another object of the invention is to provide a hydrophilic ink delivery and filtration medium for a cartridge that is capable of absorbing or extracting ink from the ink chamber or ink storage medium and delivering the filtered ink to the printhead.

Another object of the invention is to provide an ink delivery and filtration medium that is selectively layered with materials having a predetermined pore size and porosity.

Another object of the invention is to provide an ink delivery and filtration medium that is capable of multiplanar filtration to sequentially remove large, intermediate, and small objects such as fibers, foam particles and debris to avoid clogging areas of ink passage in a cartridge and, in particular, in the printhead; this sequential filtration process is also called a selective filtration or gradient filtration process.

Another object of the invention is to provide an ink delivery and filtration medium with a layered structure which comprises a combination of at least one layer of woven material and at least one layer of a thermally extruded or molded porous material.

Another object of the invention is to provide an ink delivery and filtration medium comprising a composite of porous layered materials.

Another object of the invention is to provide an ink delivery and filtration medium that is capable of having different physical forms to accommodate differently constructed ink cartridges or ink reservoirs including multiplanar and tubular structures.

Another object of the invention is to provide an ink delivery and filtration medium with improved thermal stability and ink compatibility particularly at an elevated temperature during operation, shipping and storage.

Another object of the invention is to provide a material for the ink delivery and filtration medium that can be easily cleaned and does not generate loose fibers.

Another object of the invention is to provide an ink delivery and filtration medium that can serve as a porous capillary barrier and also prevents air bubbles from entering the printhead.

Another object of the invention is to provide an ink delivery and filtration medium that does not impede ink delivery so that a high quality print with good optical density can be obtained.

The foregoing objects are obtained by the invention, which includes an ink delivery and filtration medium for ink jet printing systems. The ink delivery and filtration medium comprises a porous medium that has a controllable pore size and porosity. In a preferred embodiment, the ink delivery and filtration medium comprises a woven material. In a further preferred embodiment the woven material in accordance with the invention includes monofilament fibers such as nylons, polyethylene, polypropylene, polyethersulfone, polyesters, rayon, polyvinylidene fluoride, polytetrafluoroethylene. The woven material is flexible, thermally stable during usage, chemically resistant to the attack by ink ingredients, and washable and cleanable to meet stringent requirements of ink delivery and filtration. The pore size and porosity of the woven material can be controlled by controlling the number of stitches per inch, fiber stitching pattern, and fiber thickness or diameter. In addition, the porosity can be controlled by layering the woven material into any shape desired. In addition, the woven material can be layered with any combination of woven materials having any desired pore size for each layer. Accordingly, not only can the pore size of each layer be controlled, but the porosity of the entire medium can be controlled by cumulative stacking of layers of woven materials with the same or different pore sizes. The ink delivery and filtration medium and, more particularly, the sequential filtration process provide smooth ink flow to the printhead without undesired ink clogging and impedance thereby substantially eliminating jetting problems such as missing jets, exploding jets, and ink misdirection. In addition, restricted ink flow due to inefficient filtration and blockage of ink flow by particles, debris or fibers, which cause slow ink refill and air ingestion problems resulting in slow printing speed and poor ink jet print quality are also avoided or minimized by the steady and strong flow of ink produced and maintained with the invention. The woven material for the ink delivery and filtration medium is woven with continuous monofilament and multifilament materials without loose fibers and does not suffer from the loose fiber, debris and particle problems that existing felts and foam suffer from. The ink delivery and filtration medium can be used, for example, in an ink cartridge for an ink jet printing system. In addition, the woven material can be selected from nylons (a form of polyamide), polyethylene, polypropylene, polyesters, polyacrylnitrile, polyethersulfone, polytetrafluoroethylene, polyvinylidene fluoride, cellulose (rayon), glass fibers and any combination thereof either in monofilament or multifilament form. The woven materials in accordance with the invention are flexible, thermally stable under operation, and chemically resistant to common ink ingredients used in the ink jet applications.

Other objects, advantages and salient features of the invention will become apparent from the following detailed description, which, taken in conjunction with the annexed drawings, discloses preferred embodiments of the invention.

BRIEF DESCRIPTION OF THE DRAWINGS

Referring now to the drawings which form a part of the disclosure.

DETAILED DESCRIPTION OF PREFERRED EMBODIMENTS

Figure 2:
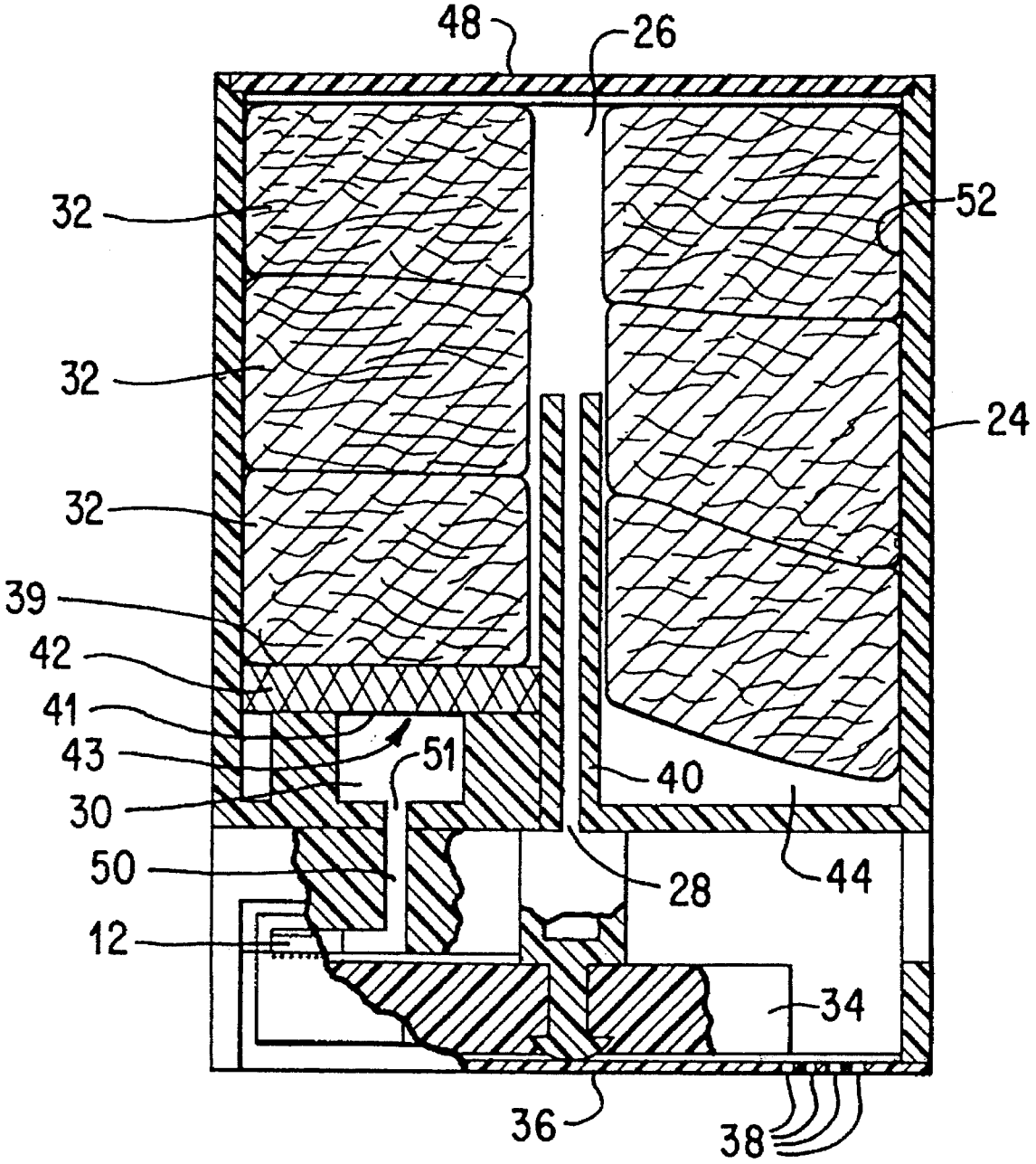
FIG. 2 is a sectional view of an embodiment of an ink cartridge incorporating the invention.
Figure 3:
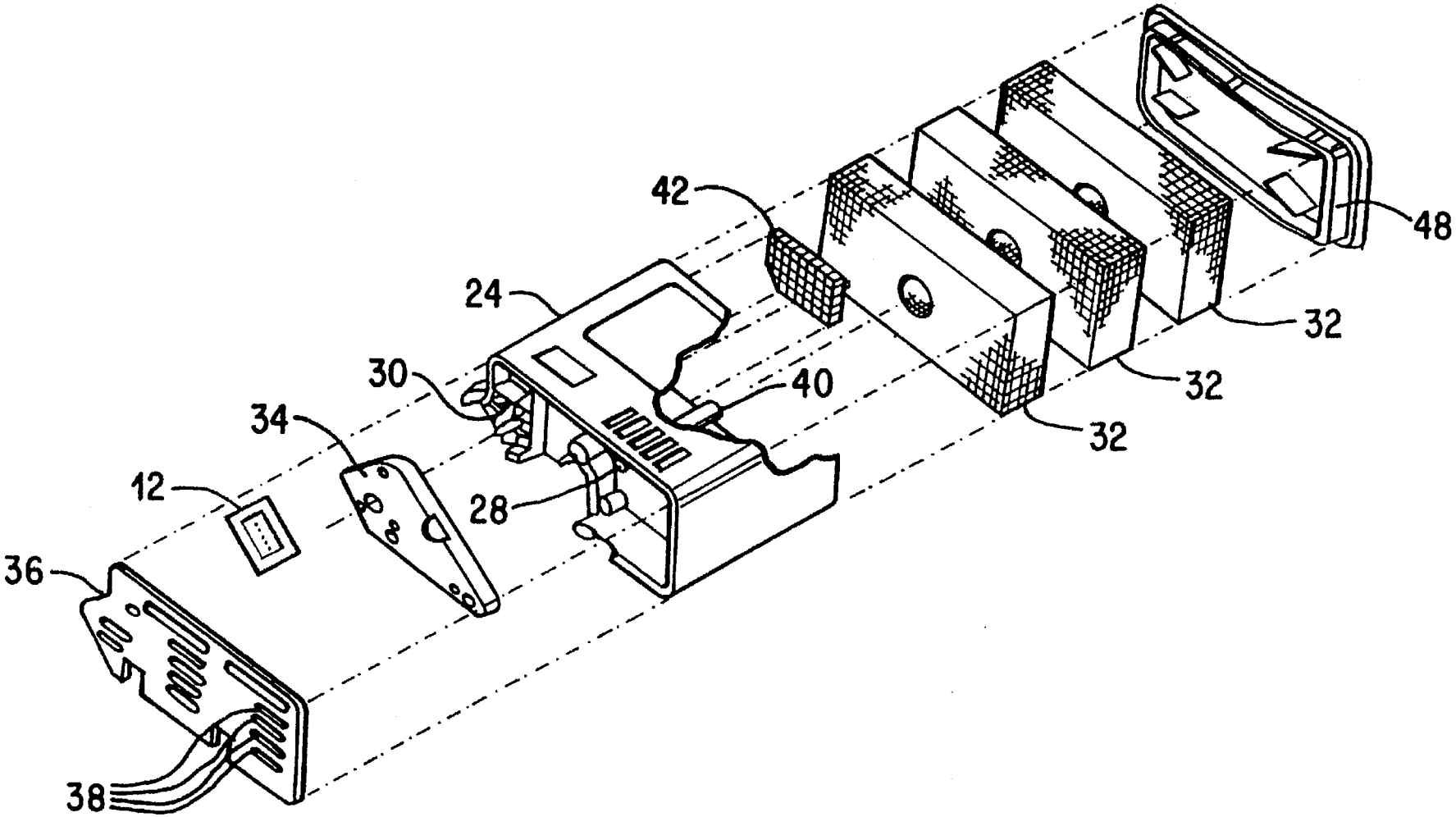
FIG. 3 is an exploded view of the ink cartridge shown in FIG. 1 incorporating the invention.
Figure 6:
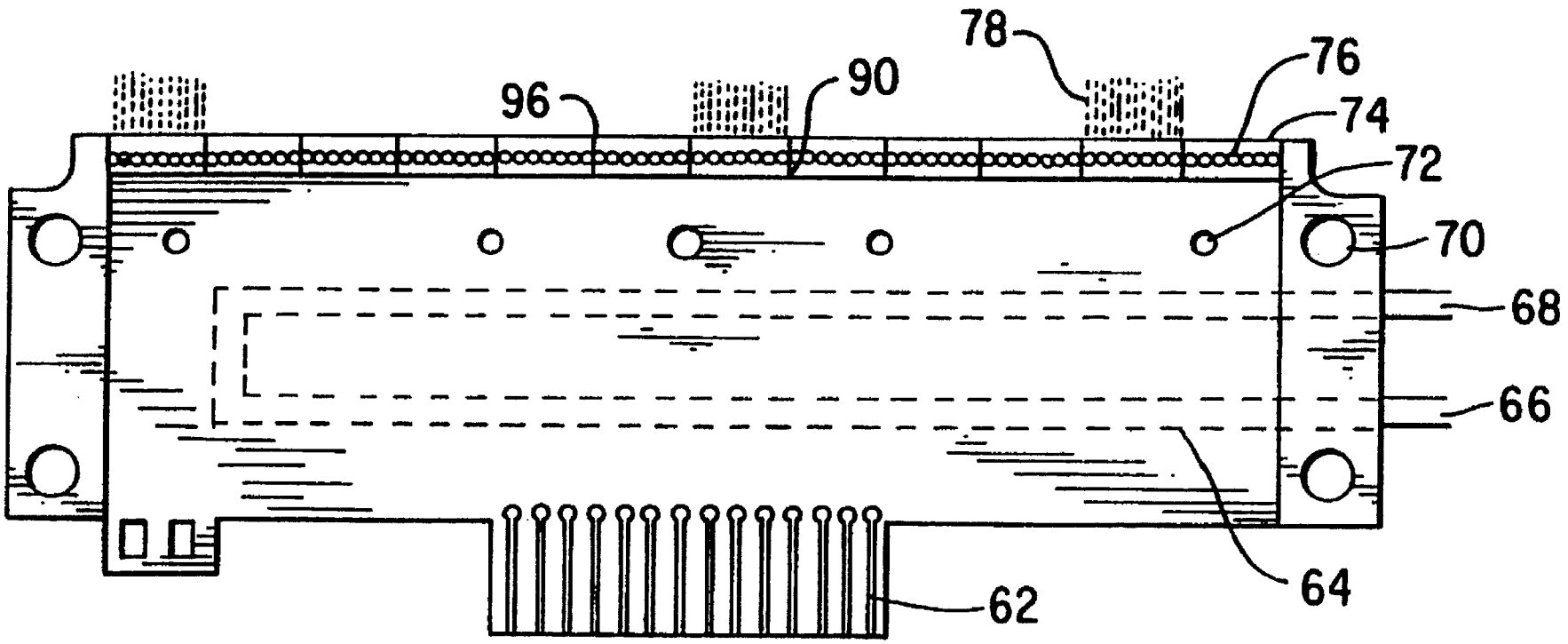
FIG. 6 is a top view of a fullwidth array thermal ink jet printhead.
Figure 7:
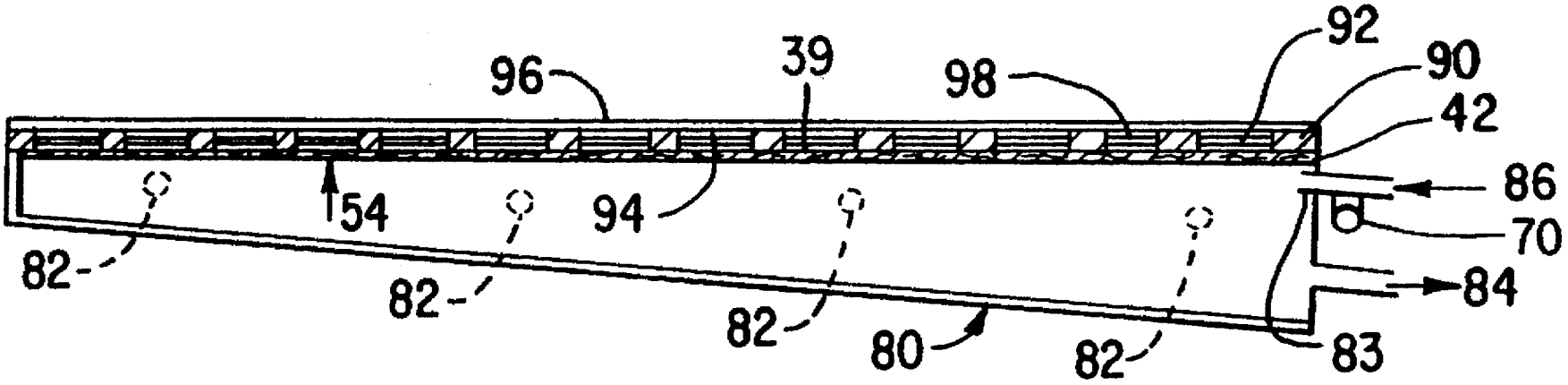
FIG. 7 is a top view of an ink supply device for the fullwidth array printhead shown in FIG. 6 incorporating the invention.

For purposes of illustration, the invention will be described for use, for example, in an embodiment of an ink cartridge as disclosed in U.S. patent application Ser. No. 07/885,704 having the same assignee and incorporated herein by reference. An embodiment of the ink cartridge incorporating the invention is shown in FIGS. 2 and 3. It is, however, within the scope of the invention to use any commercially available cartridge. For purposes of further illustration, the invention will also be described below for use in an embodiment of a fullwidth array thermal ink jet printhead as shown in FIGS. 6 and 7. Furthermore, it is within the scope of the invention to incorporate the ink delivery and filtration medium into any type of ink delivery system and is not limited to use in thermal ink jet printing systems.

Figure 1:
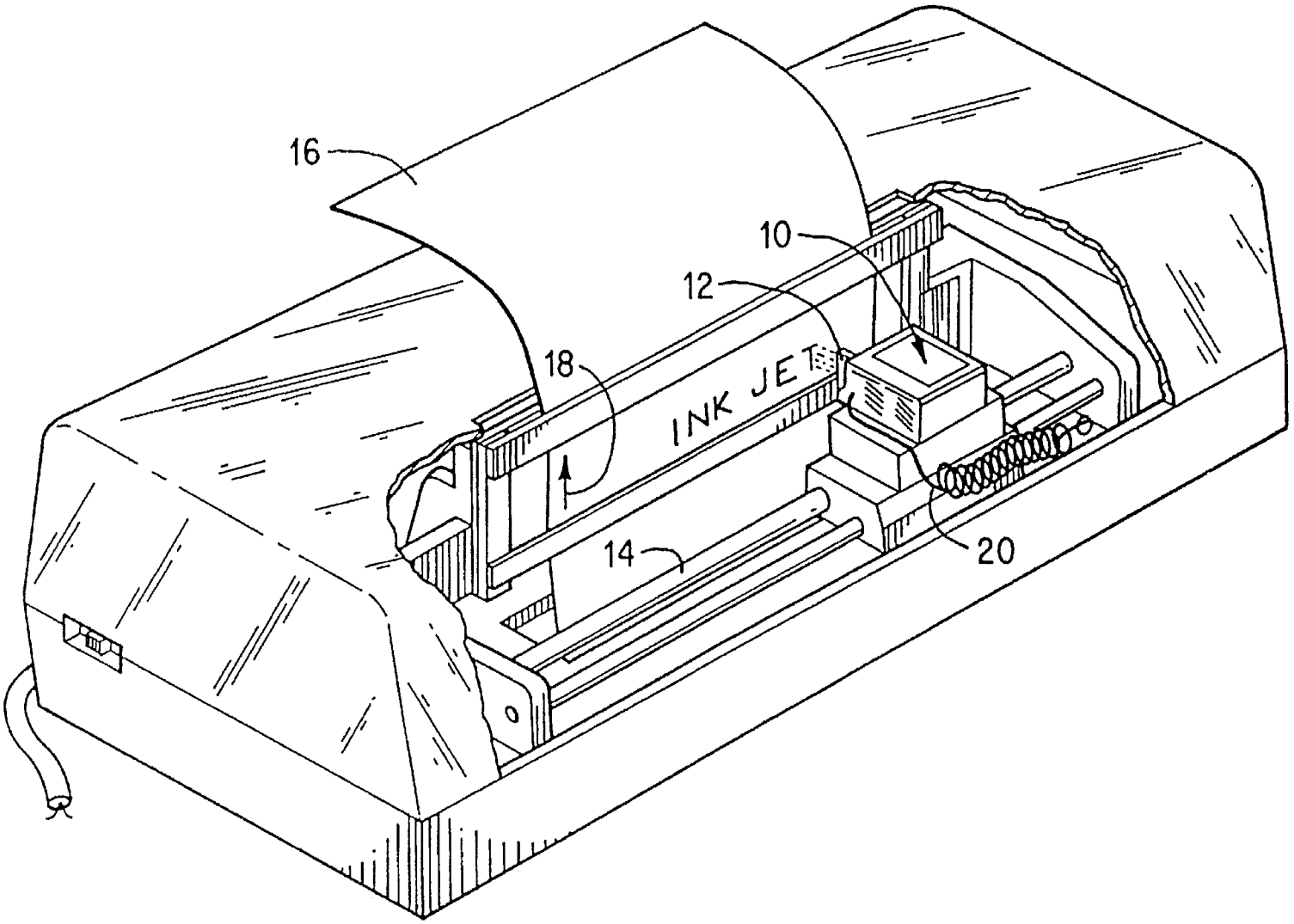
FIG. 1 is a view of a thermal ink jet printer having an ink cartridge and a printhead.

FIG. 1 is a general view of a type of thermal ink jet printer in which the printhead and the ink supply are combined in a single package, referred to as cartridge 10. The main portion of cartridge 10 comprises the ink supply system and the printhead 12. In this embodiment of the invention, cartridge 10 is placed within a larger thermal ink jet printing apparatus. The cartridge 10 is caused to move along carriage 14 in such a way that printhead 12, moving relative to a sheet (or any recording medium) 16, may print dots and characters on the sheet 16 as the cartridge 10 moves across the sheet, somewhat in the manner of a typewriter. In the illustrated example, printhead 12 is of such a dimension that each path of cartridge 10 along sheet 16 enables printhead 12 to print out a portion of a line or a single line of text, although it is generally not necessary for the text lines to conform to swaths of the cartridge 10. With each swath of cartridge 10, sheet 16 may be indexed (by means not shown) in the direction of an arrow 18 so that any number of passes of printhead 12 may be employed to generate text or an image onto the sheet 16. Cartridge 10 also includes means, generally known as 20, by which digital image data signals may be entered into various heating elements of the printhead 12 to print out the desired image. These means 20 may include, for example, circuitry, electrical connections or plug means which are incorporated in the cartridge 10 and which accept electronic data signals through a bus or cable from a data-processing portion of the ink jet printer and permit an operative connection to the heating elements in the printhead 12.

FIG. 2 is a sectional view of the cartridge 10. The cartridge 10 has a large portion in the form of a housing 24 and a cover plate 48. Housing 24 is typically made of lightweight but durable plastic. An inner wall 52 of housing 24 defines a chamber 26 for the storage of liquid ink, a vent opening 28 open to the atmosphere and the chamber 26, an ink outlet 51 and an ink well 30. Ink well 30 is in fluid communication with an ink outlet 51, which is connected by an ink channel 50 to the ink jet printhead 12 to supply ink to the printhead 12. An ink filtration outlet area 43 is shown in FIG. 2 to be located in an area between a first side 41 of an ink delivery and filtration medium 42 and ink well 30 near the top of the ink well 30. In another embodiment, the ink filtration outlet area 43 can be located between the first side 41 and the ink outlet 51. In a preferred embodiment, ink delivery and filtration medium 42 abuts, in part, a portion of the inner wall 52 near ink well 30. Also seen in FIG. 2 is a second side 39 of the ink delivery and filtration medium 42 abutting the ink storage medium 32. The first side 41, of the ink delivery and filtration medium 42 is the outermost or last layer that the ink has to pass through in the medium 42 before reaching the ink filtration outlet area 43 and ink outlet 51. In another embodiment, the ink storage medium can be absent or of such a size that the second side 39 abuts the liquid ink only. An ink storage medium 32, shown here as three separate portions each marked 32, occupies most of the chamber 26 of housing 24. Open space 44 is provided for ink overflow and air pressure equalization.

FIG. 3 is an exploded view of cartridge 10 (not to scale), showing how the various elements of cartridge 10 may be formed into a compact customer-replaceable unit. Other parts of the cartridge 10, which are useful in a practical embodiment of the invention include a heat sink 34 and vented cover 36 having openings 38 to permit ventilation of, for example, heat from the interior of a lower portion of the housing 24. A practical design will typically include space for on-board circuitry for selective activation of the heating elements in the printhead 12.

Also shown in FIGS. 2 and 3 is an air vent pipe 40 extending from the vent opening 28 (connected to an outside atmospheric pressure) toward a center of an interior of housing 24 or chamber 26 (FIG. 2) for pressure equalization.

In the embodiment shown in FIGS. 2 and 3, ink storage medium 32 can include a needled felt of polyester fibers. Needled felt is made of fibers physically interlocked by the action of, for example, a needle loom, although in addition the fibers may be matted together or treated by soaking or steam heating or pressing. In an embodiment of the invention, the needle felt can be of a density of between 0.02 and 0.25 grams per cubic centimeter. The optimum density of this polyester needled felt forming the ink storage medium 32 is preferred to be approximately 0.095 grams per cubic centimeter. This preferred density of the felt reflects a good volume efficiency for holding liquid ink. A type of felt suitable for this purpose is manufactured by BMP of America, Medina, N.Y. Other chemically resistant felts made of nylon fibers or melamine polymer fiber can also be used for the ink storage medium 32 in the cartridge provided they are compatible with the ink used in ink jet printing. Porous polymer foams with desired hydrophilicity and interconnecting networks can also be employed as an ink storage medium 32 in the cartridge.

In order to provide the back pressure of liquid ink within the desired range, while still providing a useful volume efficiency and portability, the polyester fibers forming the needled felt should be of two intermingled types, the first type of polyester fiber being of a greater fineness than the second type of polyester fiber. Specifically, an example of advantageous composition of needled felt comprises approximately equal proportions of 6 denier and 16 denier polyester fibers.

Ink storage medium 32 is packed inside housing 24 in such a manner that the felt exerts reasonable contact and compression against the inner walls 52 and the ink delivery and filtration medium 42. In one commercially practical embodiment of the invention, the ink storage medium 32 is created by stacking three layers of needled felt, each one-half inch in thickness, and packing them inside the housing 24.

In accordance with the invention, the porous ink delivery and filtration medium 42 is positioned in the housing 24 in an area between the ink storage medium 32 and ink filtration outlet area 43 (FIG. 2) to deliver and filter ink flowing from the ink storage medium 32 to the ink outlet 51 and the printhead 12. Alternatively, the ink delivery and filtration medium can also be located between the ink in the chamber 26 and the ink filtration outlet area 43 to filter and deliver the ink to the ink outlet 51 and the printhead and, therefore, with or without the use of the ink storage medium 32.

In a preferred embodiment of the invention, the ink delivery and filtration medium 42 is made of a woven material with controllable pore size. It is important that the woven materials selected be hydrophilic (for aqueous ink application) as well as porous to allow ink to flow easily therethrough. Since at least the pore size of a woven material is capable of being controlled, in addition to providing good capilarity, it is ideal for use as an ink delivery and filtration medium. In addition, the woven material for the ink delivery and filtration medium is woven without loose fibers and does not suffer from loose fiber, debris and particle problems.

Figure 5A:
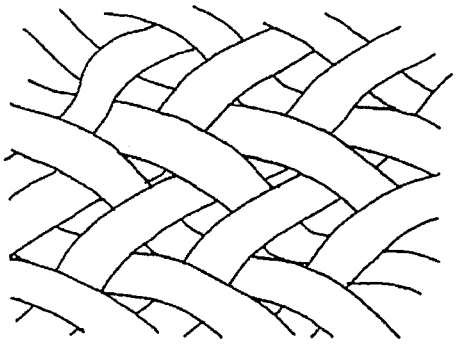
FIGS. 5A, 5B, 5C, 5D, 5E, 5F, 5G, 5H, 5I, 5J and 5K show nonlimiting examples of woven mediums for use with the invention.
Figure 5B:
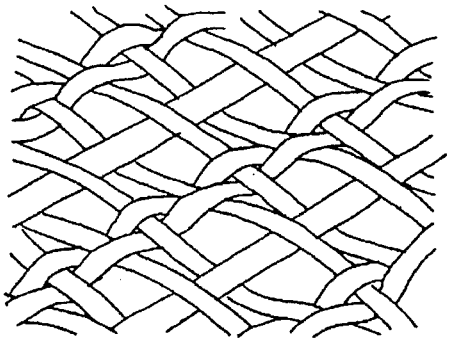
Figure 5C:
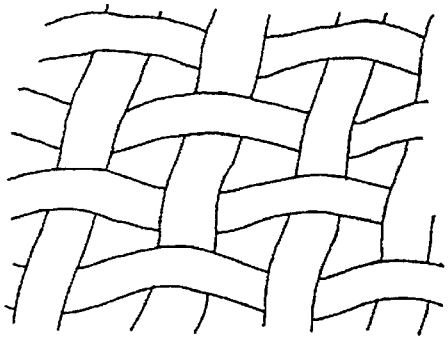
Figure 5D:
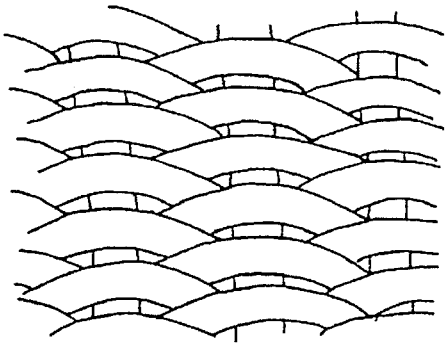
Figure 5E:
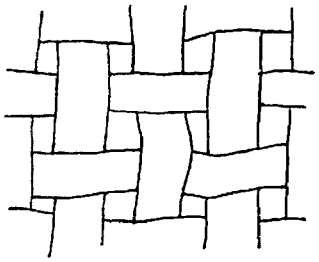
Figure 5F:
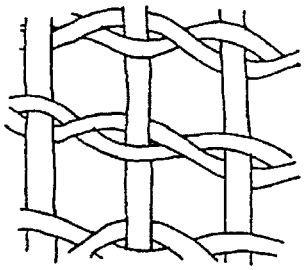
Figure 5G:
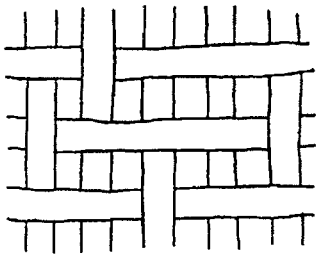
Figure 5H:
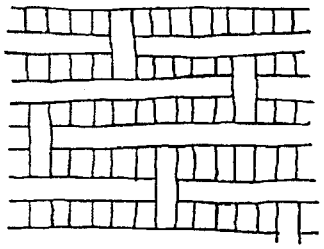
Figure 5I:
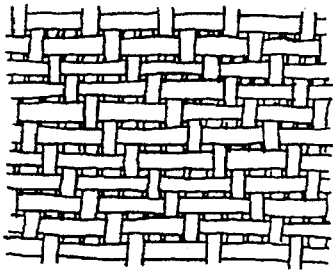
Figure 5J:
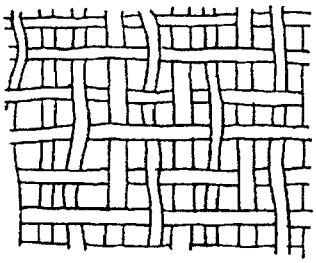
Figure 5K:
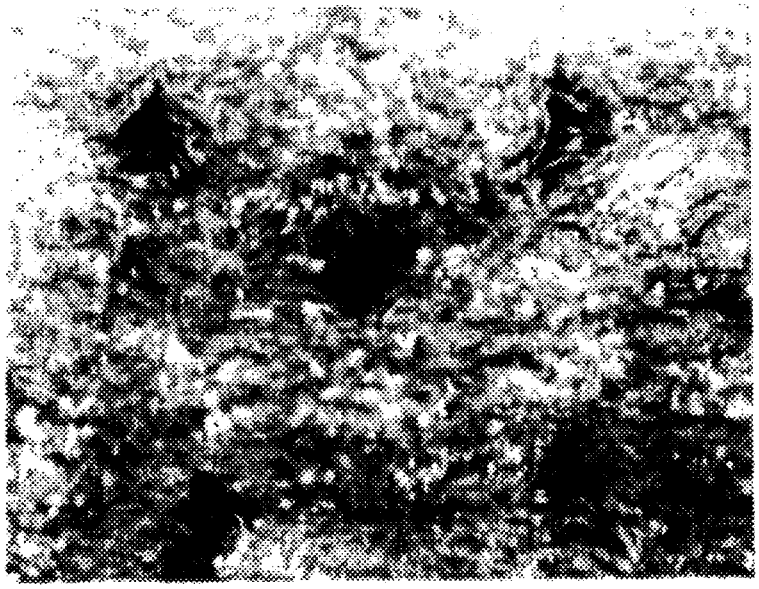

FIGS. 5A, 5B, 5C, 5D, 5E, 5F, 5G, 5H, 51, 5J and 5K show a plurality of different weave patterns, for purposes of illustration, that can be used in accordance with the invention to achieve different porosities. FIGS. 5A–D are some weave patterns preferable for polymer fiber fabrics, FIGS. 5E–J are weave patterns preferable for glass fiber cloth and FIG. 5K is a photomicrograph of Miracle Wipe 4000, which is a woven Nylon material prepared with monofilament Nylon fiber. In particular, 5A shows twill weave, 5B shows special taffeta weave, 5C shows square weave, 5D shows plain reverse dutch weave, 5E shows plain weave, 5F shows leno weave, 5G shows crowfoot satin weave, 5H shows 8 harness satin weave, 51 shows 3x1 twill weave and 5J shows high modulus weave. FIG. 5K shows a plurality of monofilament Nylon fibers with holes or pores (dark areas in the FIG. 5K) formed therein for ink delivery. Some of the woven materials mentioned can be obtained from Spectrum Company of Texas, Tetko Inc of New York and TexWipes Co. (supplier for VWR Scientific Co.).

The pore size and porosity of the woven material can be controlled by, for example, the number of stitches per inch, the fiber stitching pattern and the fiber thickness or diameter. The pore size and porosity of woven material can be varied in accordance with the ink flow rate required. For example, the woven material has pores having pore sizes. In one embodiment of the invention, the woven material has an average pore size in the range of 0.1 microns to 5500 microns. In a preferred embodiment of the invention, the woven material has an average pore size in the range of 0.1 microns to 2000 microns. In accordance with the invention, for example, a fine layer for positioning as an outer most layer adjacent to a printhead side has a fine pore size within a range of 1 to 130 microns and more preferably 1 to 30 microns. The selected woven material can have a porosity or an opening area that varies based on the weave and is preferably in the range of 0.1% to 74%. In a further preferred embodiment the woven materials have an opening area ranging from 1% to 50%. The woven material can have fibers having a diameter in a range of 10 to 2000 microns.

In addition to an individual piece of woven material having a controllable porosity, the porosity can further be controlled by layering the woven material. A stack of layers of woven material can be bound together, for example, by stitching, molding, lamination with a thermally fusible polymer, ultrasonic welding, adhesive coating and bonding so long as the final product can maintain the desired integrity, porosity and hydrophilicity needed for the ink jet application.

Since the thickness of some woven material tends to be small, for example, less than 1/16 of an inch the woven material is ideal for stacking to a sufficient thickness useful in ink delivery and filtration medium applications. In addition, to enhance the rigidity and thickness of the ink delivery and filtration medium the following substantially rigid materials can be used in conjunction with the woven material, such as coarse polymeric netting materials, fabrics, and sintered porous plastics and materials including polyethylene, polypropylene, polyvinylidene fluoride, polytetrafluoroethylene, polyolefin, polyurethane, polyesters, Nylons, polycarbonate, and polyethersulfone. Some of these materials can be obtained from Porex Technologies of Georgia, Spectrum Company of Texas, and Tetko Inc of New York. In one embodiment in accordance with the invention the woven material is interfaced with a porous plastic that can be thermally extruded or molded in the form of a grid, a net, a block or screen.

Figure 4:
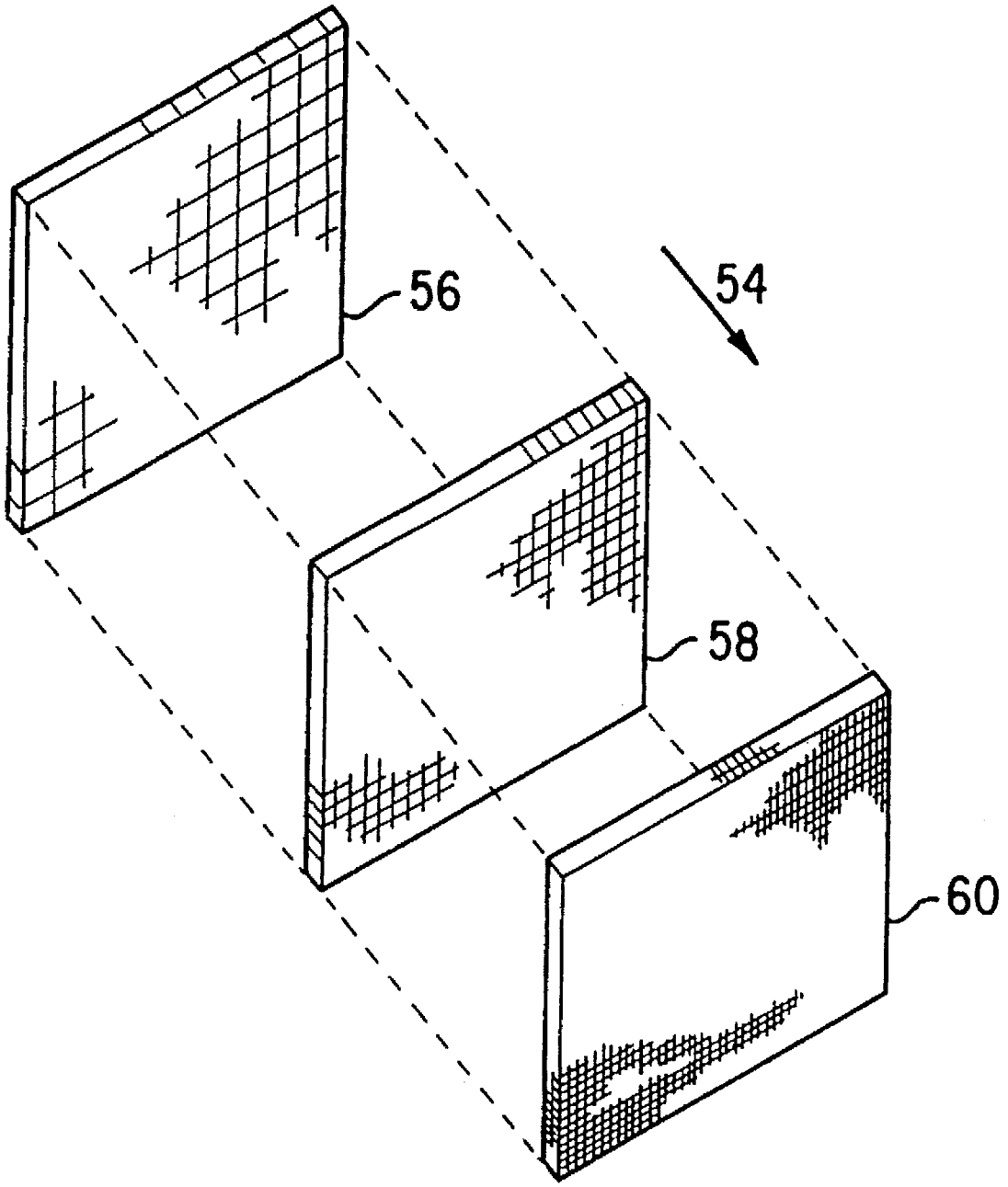
FIG. 4 shows an exploded view of an embodiment of an ink delivery and filtration medium in accordance with an embodiment of the invention.

In one embodiment of the invention, the woven material layers can be arranged in a stack sequentially according to pore size. FIG. 4 shows an example of an embodiment of sequentially arranged layers of woven material arranged according to their pore size. Ink flow arrow 54 illustrates the direction of ink flow toward the printhead 12. Layers 56 represents a coarse woven material having a large pore size in combination with a layer 58, which is a woven material having an intermediate pore size, and layer 60, which is a finely woven material having a relatively small pore size. Accordingly, during ink flow, particles, loose fibers, and debris are filtered out sequentially along the ink path toward the printhead by each filter 56, 58, 60. An advantage of this embodiment, is that different size particles, fibers, and debris can be filtered out at different layers without stopping the ink flow. Thus, the buildup of particles, fibers, and debris simply redirects the ink flow around and past the particles, fibers, and debris lodged in the ink delivery and filtration medium 42 so as not to impede the steady and strong ink flow which is required for smooth ink jet printing. The steady and strong ink flow is especially important for proper ink refill at the printhead, for ink supply and high speed printing In addition, by filtering particles, fibers, and debris out through the layers, the probability of complete or total filtration of particles, fibers, and debris without clogging is greatly enhanced. Furthermore, the efficient ink delivery and filtration process provided by the multilayer structure in accordance with the invention also further minimizes or eliminates jetting problems such as missing jet, exploding jet, misdirectionarity, and poor solid area coverage.

In other embodiments of the invention, each layer of woven material has the same average pore size, or has any desired combination of layers having different average pore sizes such that a stack of layers can be constructed to have any desired final filtration porosity. In any of the above described embodiments, however, by stacking layers of woven material, particles, fibers and debris tend to be filtered out at different layers, so that undesirable particles, fibers and debris are dispersed throughout the ink delivery and filtration medium 42. Therefore, as previously discussed with respect to the embodiment shown in FIG. 4, ink can travel around the particles, fibers, and debris through alternate paths in contrast to building up along a single surface of a filter, which creates undesired blockage and limiting of the steady strong ink flow.

In another embodiment, by layering the woven material, the pores of each layer can be controllably aligned so that predetermined ink channels can tie established for directing the ink along a particular path. For example, a number of coarse woven material layers with large pores can be positioned such that the pores are misaligned with an adjacent woven layer thus creating effectively a small porosity ink delivery and filtration medium.

In another embodiment, the pore sizes of the ink delivery and filtration medium 42 can be made to accommodate various types of ink. In particular, the pore size and porosity can be controlled to accommodate dye based ink which does not contain particulate material. Whereas, another ink delivery and filtration medium 42 can be constructed to accommodate pigment based ink which usually contains pigment particles less than 5 microns and preferably less than 1 micron.

In accordance with the invention, the woven material can include organic and inorganic materials that may contain synthetic or naturally occurring materials. In particular, woven material made with Nylons (Nylons 6, 6/6, 12 etc.), polyacrylates, polyesters, glass, cellulose (e.g. Rayon or cotton), wool, polyethylene, polypropylene, polyethersulfone, polycarbonate, polyamide, (e.g. Aramid), polytetrafluoroethylene, polyurethane, polyvinylidene fluoride, metal and derivatives and combinations thereof. Both continous monofilament and multifilament fibers can be used in the preparation of the woven material in any desired weaving pattern including those shown in FIG. 5.

In another embodiment many porous materials including porous ceramics, sintered glass, porous steel, and porous plastics such as polyethylene, polypropylene, polysulfone, polycarbonate, nylons, polyvinylidene fluoride, etc. can also be used alone or in combination with any aforementioned woven material such as Nylon in the construction of the ink delivery and filtration medium.

In another embodiment of the invention the woven material for ink delivery and filtration medium is made of monofilament fabrics which can be put together by mechanical stitching, thermal lamination with or without an adhesive, or using a chemically resistant glue for coating, or by a treatment involving heat and pressure. Care and consideration should be taken in the use of glue or adhesive so that it will not cause any undesired blockage of the pores and ink flow.

In accordance with another embodiment of the invention, the woven material of the ink delivery and filtration medium can be washed, cleaned, handled, cut, stamped, and packaged in a cleanroom environment. Some of the woven fabrics are commercially available for cleanroom use including cleanroom wipers such as Miracle Wipe 4000, a Knitted Nylon Class 100 Cleanroom Wipers (a woven fabric of monofilament nylon which was washed and cleaned by Texwipe Co. under Class 100 cleanrooms conditions), Performx 900 (a nylon fabric made by Berkshire Co. ), Super Polx 1200 wipers (a double-knit polyester made with monofilament yarn which has low particle generation and extractable material), Super Polx 1200 wipers (made by Bershire Co. with continuous monofilament of polyester), Alpha Wipes Class 100 Cleanroom wipers Cleanroom wipers (Interlock knit, "No-run" cloth made from continuous filament polyester washed and packaged in Class 100 cleanrooms), Alpha 10 wiper (Double knit polyester Ultra-Hem 2000 (made of 100% polyester continuous filament by Bershire Co.)), and other similar commercial products.

In accordance with another embodiment of the invention, the ink delivery and filtration medium 42 can receive or draw ink for delivery to the printhead 12. In an embodiment, woven material of the ink delivery and filtration medium has very small size pores which can provide excellent capillary force for absorbing or receiving ink from an ink reservoir or ink storage medium 32 in the cartridge and transferring the ink effectively to the ink outlet 51 and the printhead 12 after the filtration. In general, the smaller pore size of the medium will have larger capillary force (or capillary action) for absorbing or extracting ink. It is important to select a woven material for the ink delivery and filtration medium with proper pore size with optimum capillary force and hydrophilic property (for aqueous ink application) to assure effective transfer of the ink from the storage medium 32 to the printhead 12, even under conditions of high rate ink demand.

In another embodiment, the ink delivery and filtration medium 42 has a small pore size and prevents undesired air bubbles from passing therethrough.

In another embodiment the ink delivery and filtration medium can be used with aqueous or nonaqueous inks including either dye or pigment, or a combination of dye and pigment. If a woven material is hydrophobic, it can be used for a nonaqueous ink. In accordance with the invention, the woven materials are preferably hydrophilic for use in ink jet application which utilizes aqueous inks (comprising water).

In addition in accordance with the invention, the woven fabric is chemically inert for use with commonly used ink ingredients and does not leach or react with penetrants, humectants, dye or pigment constituents, or other ink ingredients in the ink. Furthermore, the woven material is thermally stable, such that heat associated with the heater means in a thermal ink jet printer, or associated with storage in a warm warehouse or shipment in hot weather will not undesirably affect or change the material and ink property.

FIGS. 6 and 7 show another embodiment of the invention incorporating the ink delivery and filtration medium into a thermal ink jet system having a fullwidth array printhead which is made by butting an array of small printheads. In particular, FIG. 6 shows a top view of a fullwidth array thermal ink jet printhead. Electrical connectors 62 are shown for electrically connecting the fullwidth array thermal ink jet printhead with an electrical source. The fullwidth array thermal ink jet printhead (FIG. 6) includes an electrical circuit board 64 and a cooling fluid channel inlet 68 and a cooling fluid channel outlet 66 for removal of heat by passing cooling fluid through the cooling fluid channel below the board 64 comprising the fullwidth array printhead. A mounting hole 70 (FIG. 7) and a small inserting hole 72 (FIG. 6) are provided for connecting the fullwidth array printhead and the ink supply device. Also shown is a multiple jet printhead 74 (put together in a series) with many ink holes 76 located on a top side (which connects to the ink supply device shown in FIG. 7) of multiple jet printhead 74 which jets ink droplets 78.

FIG. 7 shows a top view of an ink supply device for supplying ink to the fullwidth array printhead shown in FIG. 6 and, which is positioned substantially on top of the electrical circuit board comprising the fullwidth array printhead seen in FIG. 6. The ink supply device (FIG. 7) includes, for example, a supply housing 80, mounting inserts 82 (not shown, and located below 80) for alignment with small inserting hole 72 (FIG. 6) and an ink inlet tube 86 and an ink outlet tube 84 associated with the supply housing 80. Another embodiment of ink delivery and filtration medium 42 is shown adapted for use with the thermal ink jet printer having a fullwidth array printhead. A plurality of spacers 90 between the ink delivery and filtration medium 42 and a front edge 96 define ink flow areas 92 (with an open slit) where ink flows to ink holes 76 (in FIG. 6) and then to the printhead. For purposes of illustration, the ink flows through ink inlet tube 86, passes through the porous ink delivery and filtration medium 42 in a direction of ink flow arrow 54, through the slotted ink flow areas 92 and into the ink holes 76 (FIG. 6) on the multiple jet printhead 74 and then into the ink channels in the printhead. The back pressure in accordance with this embodiment can be controlled by providing an ink storage medium in the ink supply housing 80 or by lowering the ink level in a connecting ink reservoir relative to the ink level in the printhead or by any other means. The ink reservoir (not shown) is connected to the ink housing 80 through the ink inlet tube 86 seen in FIG. 7. The second side 39 of the ink delivery and filtration medium 42 as seen in FIG. 7 abuts the liquid ink, however, an ink storage medium can be used.

Figure 9:
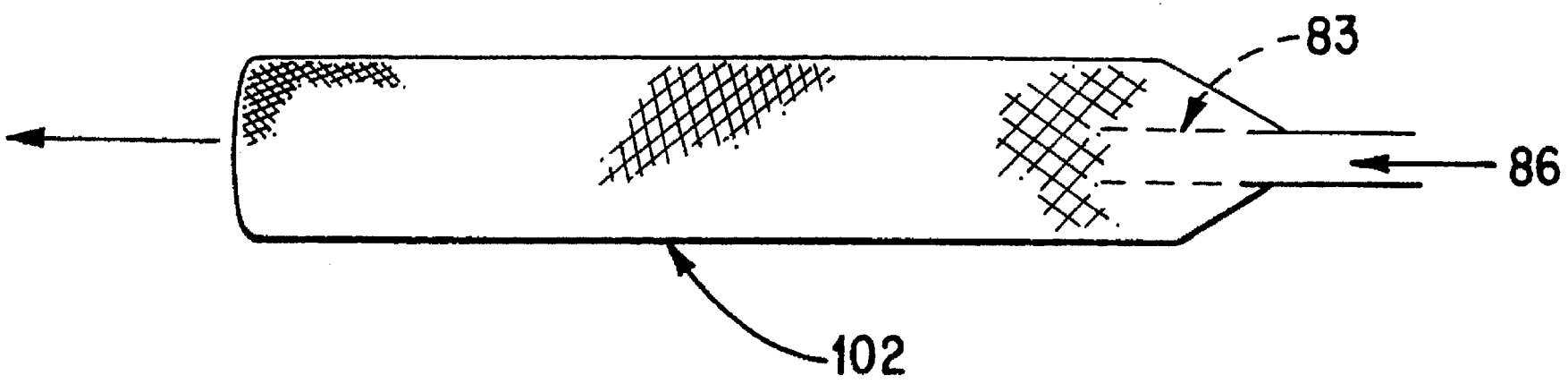
FIG. 9 is another embodiment of the ink delivery and filtration medium.

In another embodiment the ink delivery and filtration medium can also be in a tubular form 102 shown in FIG. 9, which can be attached to an ink inlet tube discharge port 83 (FIG. 7) to filter the ink before the ink fills the housing and then enters into the ink flow areas 92 and the printhead 74 (FIG. 6).

Figure 8:
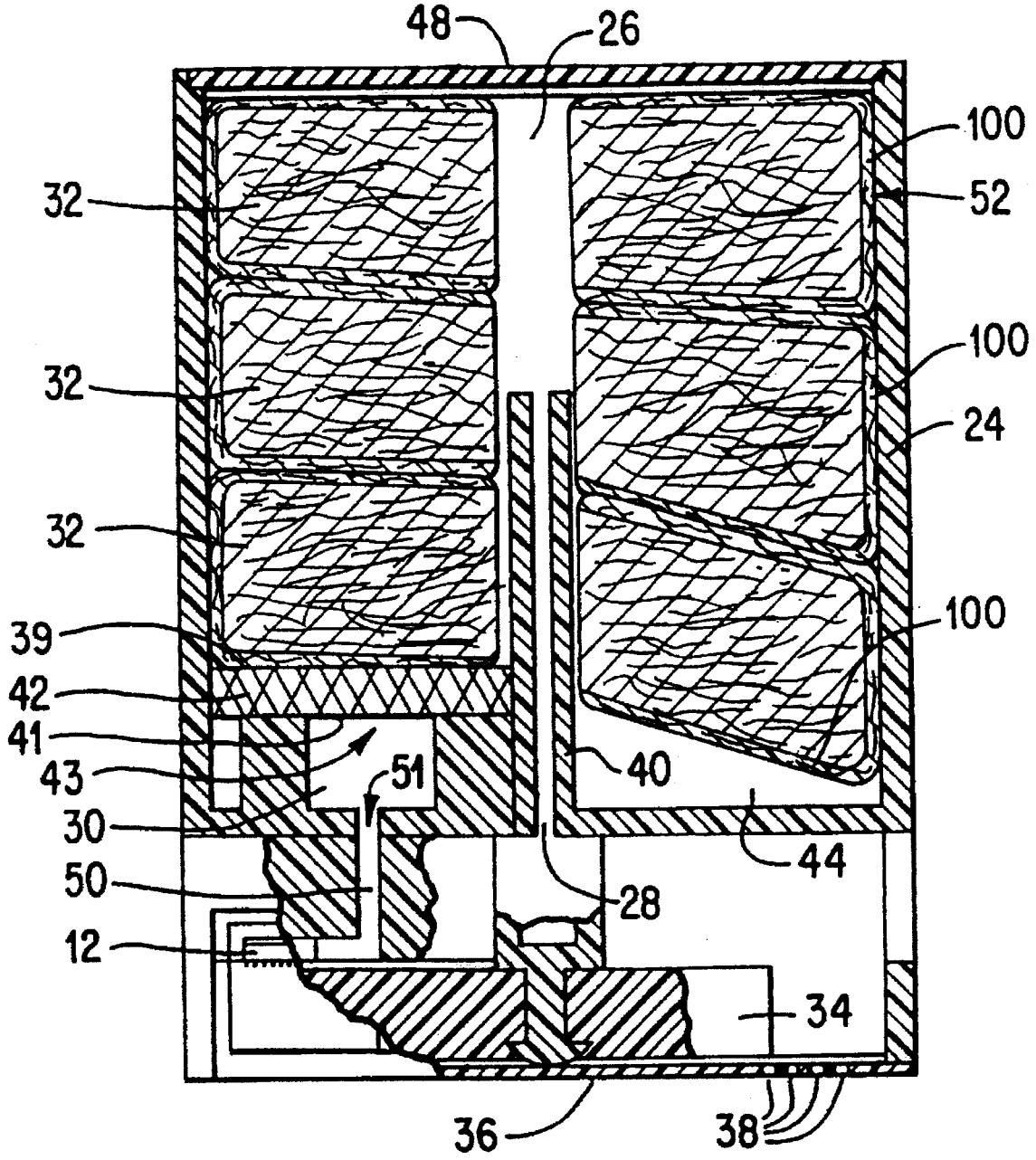
FIG. 8 is a sectional view of an embodiment of an ink cartridge incorporating another embodiment of the invention.

FIG. 8 shows another embodiment in accordance with the invention where the ink storage medium 32 is covered on substantially an entire surface area with a covering 100 of porous woven material in accordance with the invention. Covering 100 serves as a prefilter and aids the ink delivery and filtration medium 42 in filtering particles, fibers and debris generated by the ink storage medium 32. The use of covering 100 is advantageous especially when the ink storage medium 32 comprises felts made of loose fibers. In another embodiment the covering 100 can also cover a plurality of the ink storage mediums 32 as a single unit and furthermore, any way of covering differently constructed ink storage mediums is within the scope of the invention.

The following examples are provided for purposes of illustration, and are not intended to limit the scope of the invention. These examples are intended to be illustrative, and the invention is not limited to the materials, conditions, or process parameters set forth in these embodiments. It is understood that variations and modifications are possible and are within the spirit and scope of the invention.

Many dye based inks and pigment based inks with different colors (e.g. black, cyan, magenta, yellow, etc.) were used in the following demonstrations as were slow and fast drying type inks.

In one embodiment, a meshed nylon fabric cloth with porosity of about 30–50 holes per inch made with monofilament nylon fiber, Miracle Wipe 4000 (from Texwipe Co. for cleanroom operation ) was folded to give eight layers of fabric. A piece of paper towel was placed under it for a wetting and filtration test. A few drops of a slow dry dye based black ink were placed on top of the fabric. The black ink was quickly absorbed into the nylon fabric and penetrated to the other side of the fabric resulting in ink transfer to the paper towel. Similarly when a polyester felt saturated with the black ink was placed on top of eight layers of the meshed nylon fabric, smooth ink absorption and transfer were observed. In addition, good results were also observed when the ink wetting and filtration test was performed with six layers of meshed nylon fabric which were stitched together.

In another embodiment, a meshed nylon fabric (Miracle wipe 4000 knitted Nylon Class 100 Cleanroom Wiper made by Texwipe Co.) comprising four layers was laminated on a 10 micron woven polyester filter (first side 41 of the ink delivery and filtration medium 42) with a thermally fusible polymer. A wetting and filtration test including contacting a polyester felt saturated with a slow dry dye based ink on the meshed nylon fabric showed that the ink was quickly absorbed into the fabric and transferred to the other side and passed through the polyester filter. The experiment shows that the meshed nylon fabric/polyester filter package can be used as an ink delivery and filtration medium. Similar good result was also obtained when a slow dry carbon black (pigment) ink was employed in the same wetting and filtration test. A successful ink wetting and filtration test was also carried out with the Nylon/Polyester type woven material using fast dry cyan, magenta, and yellow inks. Excellent results were also obtained when a 13 micron woven Nylon filter (from Tetko Co.) was similarly used to replace the above polyester 10 micron filter in the demonstrations (Nylon/Nylon layer structure).

In another embodiment, a porous medium such as hydrophilic polyethylene plastic (⅛ thick hydrophilic polyethylene, received from Porex Technologies X-4744) was laminated with a Nylon woven fabric with a pore size of 13 microns (From Tetko Inc.) and used as an ink delivery and filtration medium. A polyester felt (ink storage medium) saturated with a black ink was placed on top of the porous hydrophilic polyethylene medium. Ink was received by the porous polyethylene medium and successfully passed through the woven Nylon fabric filter.

In another embodiment, a porous felt material made with melamine formaldehyde fibers (Basofil, similar to the melamine formaldehyde foam) was laminated on one side with a thermally fusible meshed cloth (woven Nylon fabric from Handler Textile Corporation) and the other side with a monofilament woven Nylon fabric (pore size of 13 microns). An ink wetting and filtration test similar to that described before was carried out. The result demonstrated that the felt material can also be used in construction of a multilayer ink delivery and filtration medium to receive, store and transfer ink.

In another embodiment, a porous cellulose sponge (fine porosity with 3/16" thick foam, from National Sponge Corporation) was washed, dried, laminated with a monofilament Nylon fabric (10 microns) and used as an ink delivery and filtration medium. The ink can be transferred easily from the polyester felt (ink storage medium) to the foam and then through the woven material. The cellulose foam or sponge was also treated with a bactericide to avoid bacteria growth. A slow dry cyan dye ink containing a bactericide (e.g., Dowicil 150) was successfully employed with the porous ink delivery and filtration medium comprising the cellulose sponge and a woven material (10 microns polyester) for use as an ink delivery and filtration medium.

In another embodiment, a composite material comprising lintfree nonwoven polyester and cellulose (Techni-cloth II, from Texwipe Co.) was used as an ink delivery and filtration medium. Eight layers of the composite material were put together with a woven Nylon material (10 microns, From Tetko Co.) as the bottom layer (last layer of the ink delivery and filtration medium). The layered ink delivery and filtration medium was subjected to an ink wetting and filtration test with a polyester felt saturated with a slow dry magenta dye ink. The result showed that the ink is absorbed quickly into the multilayered material comprising polyester and cellulose and easily passed through the Nylon filter.

In another embodiment, a woven material comprising Several layers of monofilament Nylon fabric was used as the ink delivery and filtration medium in the ink chamber of a cartridge for the ink jet application. A cartridge was assembled as shown in the FIG. 3 and it comprises a black dye based ink, an ink storage medium of three pieces of polyester felts, the ink delivery and filtration medium of the invention, a thermal ink jet printhead with 256 nozzles with necessary electrical connections, and a heat sink. Four pieces of woven monofilament Nylon fabric (Miracle Wipe 4000 made by TexWipe Co.) were cut into an appropriate size: They were stacked together and their edges were glued and sealed together with a polycarbonate solution to form a multilayer ink delivery and filtration medium which was placed at the location between the ink outlets and the ink storage medium as shown in the FIGS. 2 and 3. A dye based black ink about 65 ml was carefully placed into the bottom chamber of the ink cartridge. After sealing the back cover 48 (see FIG. 2 and FIG. 3) and priming the print head 12 (see FIG. 2 and FIG. 3) with vacuum, the printhead was filled with the ink. Good back pressure was maintained for the ink in the cartridge without any ink weeping the printhead nozzles. The ink cartridge was placed in a thermal ink jet printer.(MicroMarc printer of Texas Instrument co.) for printing test which included 1, 2, 3, and 4 pixels lines, numbers, characters, English text in different fonts, Kanji (Japanese), graphics, quartertone, and solid areas.

Excellent print quality with good resolution (300 dpi) was obtained on plain papers without any missing or exploding jets or undesired misdirectionarity problem. Furthermore, good solid area optical density data on different plain papers were obtained indicating that the ink delivery and filtration medium of the invention worked very well in the ink cartridge without any undesired ink blockage. The ink was received from the ink chamber through the ink storage medium followed by filtration and delivered to the printhead at a high frequency without any problems associated with ink supply and undesirable air bubbles.

The optical density data obtained by the thermal ink jet printing on different plain papers are listed here for this demonstration. They are: Gilbert bond paper: 1.31, Strathmore bond paper: 1.34, Classic Crest Paper: 1.28, Classic Laid paper: 1.36, Hammermil Fore DP paper: 1.07, Rank Xerox Champion Brazil paper: 1.36, Springhill ASA sized paper: 1.33, Xerox recycled paper 3R3704: 1.28, Memoryware paper from Canada: 1.27, Xerox Image Series smooth LX paper: 1.23, and Xerox Image Series Smooth acid sized paper: 1.27. No defects such as white spots or streaks can be seen from the print samples. Thus, a successful demonstration of the effective use of the ink delivery and filtration medium in accordance with the invention was shown.

In another embodiment, five pieces of woven Nylon fabric (Miracle wipes 4000 from Texwipe Co. with a measured pore size about 30–110 microns and pore to pore distance of about 750 microns) were stacked together and the edge was sealed with a polyester polymer. The bottom piece of the fabric was thermally laminated with an adhesive to a woven monofilament polyester fabric with a pore size of 11 microns and the following properties (mesh count: 510 per inch, thread diameter: 28 microns, fiber thickness: 60 microns, weight: 1.5 ounce per square yard and an opening area of 6%). The above configuration of the ink delivery and filtration medium represents a sequential arrangement of the woven fabric layers according to the descending pore size in the direction of ink flow. The side of small pore size woven polyester material was placed close to ink well 30 and ink outlet 51 (see FIG. 2) which connected to the printhead 12 (FIG. 2). Again, all elements in the cartridge were assembled in the same way as discussed in the last example (also see FIG. 3) except that the ink delivery and filtration medium in this case had different pore sizes and more layers with additional woven material. After priming, a print test was conducted using various patterns including 1, 2, 3, and 4 pixels lines, numbers, characters, English text in different fonts, Kanji (Japanese), quartertone, graphics, and solid areas. Excellent print quality with good resolution (300 dpi) was obtained on plain papers without any missing jets, exploding jets, undesired air bubbles or misdirectionarity problems. Very good optical density data were obtained on plain papers. These papers are listed here: Gilbert bond paper: 1.29, Strathmore bond paper: 1.32, Classic Crest Paper: 1.36, Xerox Image Series smooth LX paper: 1.22, Xerox Image Series Smooth paper: 1.26, and Champion Data Copy paper: 1.26. Again, no defects such as white spots or streaks due to inadequate ink supply can be seen from the print samples. Thus, successful demonstration of the effective use of the ink delivery and filtration medium with sequential filtration method of the invention was shown.

While several embodiments have been chosen to illustrate the invention, it will be understood by those skilled in the art that various changes and modifications can be made therein without departing from the scope of the invention as defined in the appended claims.

What is claimed is:

1. A system for supplying liquid ink to an ink jet printhead comprises:

a housing having at least one chamber for housing liquid ink and an ink filtration outlet area; and an ink delivery and filtration medium having a first side and a second side, the first side being located adjacent to the ink filtration outlet area, which is in fluid communication with the printhead and the second side abutting the liquid ink in the at least one chamber, wherein the ink delivery and filtration medium comprises a plurality of layers of porous woven material, each layer of the plurality of layers having substantially a same average pore size, thereby effecting proper ink delivery and filtration.

2. The system according to claim 1, wherein the woven material comprises one of monofilament and multifilament Nylon materials, said woven material being hydrophilic for aqueous ink application.

3. The system according to claim 1, wherein the plurality of layers are one of laminated and mechanically attached.

4. The system according to claim 1, wherein the woven material has a pore size in a range of 0.1 to 2000 microns.

5. The system according to claim 1, wherein at least one of the woven materials has a fine average pore size in a range of 1 to 130 microns.

6. The system according to claim 1, wherein the woven material is thermally stable and chemically resistant to ink.

7. The system according to claim 1, wherein the ink delivery and filtration medium comprises a wicking property based on a capillary action for drawing ink from the at least one chamber for delivery and filtration through the ink delivery and filtration medium in a direction toward the filtration outlet area and the printhead.

8. The system according to claim 1, wherein the first side of the ink, delivery and filtration medium is attached in part to a portion of an ink cartridge wall by one of an adhesive and a mechanical device and is positioned so that the ink can flow through the ink delivery and filtration medium in a direction toward the ink filtration outlet area and the printhead.

9. The system according to claim 1, wherein the ink delivery and filtration medium comprises at least one of Nylon, polyethylene, polypropylene, polyester, polytetrafluoroethylene, polyvinylidene fluoride, rayon, polyethersulfone, polycarbonate and glass fiber.

10. The system according to claim 1, wherein the average pore size of the woven material and a porosity of the woven material is controlled by at least one of a variation in number of stitches per inch, a variation in fiber stitching pattern, and a variation in fiber diameter.

11. The system according to claim 1, wherein the woven material has fibers having a diameter in a range of 10 to 2000 microns and a pore opening area in a range of 1% to 50%.

12. The system according to claim 1, wherein the porous woven material comprises a glass fiber cloth.

13. The system according to claim 1, wherein the woven material is interfaced with a porous plastic, the porous plastic is one of a thermally extruded plastic and a molded plastic in a form of one of a grid, a net, a screen, and a block.

14. The system according to claim 1, wherein the woven material comprises one of a monofilament and multifilament polyester material.

15. The system according to claim 1, wherein the printhead is a thermal ink jet printhead.

16. The system according to claim 1, wherein the printhead is a full width array type thermal ink jet printhead for printing at a high speed.

17. The system according to claim 1, wherein the ink delivery and filtration medium comprises a composite material of lintfree nonwoven polyester and cellulose.

18. A system for supplying liquid ink to an ink jet printhead comprises:

a housing having at least one chamber for housing a substantially ink filled ink storage medium and an ink filtration outlet area; and an ink delivery and filtration medium having a first side and a second side, the first side being located adjacent to the ink filtration outlet area, which is in fluid communication with the printhead and the second side abutting the substantially ink filled ink storage medium, wherein the ink delivery and filtration medium comprises a plurality of layers of porous woven material, each layer of the plurality of layers having substantially a same average pore size, thereby effecting proper ink delivery and filtration.

19. The system according to claim 18 wherein the woven material is a woven Nylon comprising one of a monofilament and a multifilament material, said woven material being hydrophilic for aqueous ink application.

20. The system according to claim 18, where the plurality of layers are one of laminated layers and mechanically attached layers.

21. The system according to claim 18, wherein the woven material has an average pore size in a range of 0.1 to 2000 microns.

22. The system according to claim 18, wherein at least one of the woven materials has a fine average pore size in a range of 1 to 130 microns.

23. The system according to claim 18, wherein the woven material is thermally stable and chemically resistant to ink.

24. The system according to claim 18, wherein the ink delivery and filtration medium comprises a wicking property based on capillary action for drawing ink from the substantially ink filled storage medium for delivery and filtration through the ink delivery and the filtration medium in a direction toward the ink filtration outlet area and the printhead.

25. The system according to claim 18, wherein the ink delivery and filtration medium comprises at least one of a polyester, Nylon, polyethylene, polypropylene, polyethersulfone, polycarbonate, polytetrafluorethylene, polyvinylidene fluoride, glass fiber, and rayon.

26. The system according to claim 18, wherein the woven material has at least a pore size and a porosity that is controlled by at least one of a variation in a number of stitches per inch, a variation in fiber stitching pattern and a variation in fiber diameter.

27. The system according to claim 18, wherein the woven material has a pore opening area in a range of 1% to 50% and a fiber diameter in a range of 10–2000 microns.

28. The system according to claim 18, wherein the woven material comprises a glass fiber cloth.

29. The system according to claim 18, wherein the woven material is interfaces with a porous plastic, the porous plastic being one of a thermally extruded plastic and a molded plastic and comprising one of a grid, a net, a block, and a screen.

30. The system according to claim 29, wherein the porous plastic comprises at least one of a polypropylene, polyethylene, polytetrafluoroethylene, polyvinylidene fluoride, polycarbonate, Nylon and polyester.

31. The system according to claim 18, wherein the woven porous material comprises one of a monofilament and a multifilament of at least one of polyester fabric and rayon fabric.

32. The system according to claim 18, wherein the substantially ink filled ink storage medium has a surface area, and the surface area is substantially covered by the porous woven material.

33. The system according to claim 18, wherein the printhead is a thermal ink jet printhead.

34. The system according to claims 18, wherein the printhead is a fullwidth array type thermal ink jet printhead which is capable of printing at a high speed.

* * * * *

UNITED STATES PATENT AND TRADEMARK OFFICE

CERTIFICATE OF CORRECTION

PATENT NO. : 5,657,065

DATED : August 12, 1997

INVENTOR(S) : John Wei-Ping LIN

It is certified that error appears in the above-indentified patent and that said Letters Patent is hereby corrected as shown below:

On the title page, in item [56], please add the following U.S. Patent Documents:

| | | | |
|---|---|---|---|
| 4,095,237 | 6/1978 | Amberntsson et al. | 346/140R |
| 4,394,669 | 7/1983 | Ozawa et al. | 346/140R |
| 4,419,678 | 12/1983 | Kasugayama et al. | 346/140R |
| 4,463,359 | 7/1984 | Ayata et al. | 346/1.1 |
| 4,638,337 | 1/1987 | Torpey et al. | 346/140R |
| 4,751,527 | 6/1988 | Oda | 346/140R |
| 4,771,295 | 9/1988 | Baker et al. | 346/1.1 |
| 4,774,530 | 9/1988 | Hawkins | 346/140R |
| 4,791,438 | 12/1988 | Hanson et al. | 346/140R |
| 4,803,502 | 2/1989 | Hashimoto et al. | 346/140R |
| 4,929,969 | 5/1990 | Morris | 346/140R |

Signed and Sealed this

Twentieth Day of January, 1998

Bruce Lehman

*Attest:*

BRUCE LEHMAN

*Attesting Officer*

*Commissioner of Patents and Trademarks*